US011933109B2

(12) United States Patent
Li et al.

(10) Patent No.: US 11,933,109 B2
(45) Date of Patent: Mar. 19, 2024

(54) METHOD FOR PREDICTING ROCK FORMATION ABRASIVENESS AND BIT WEAR

(71) Applicant: SAUDI ARABIAN OIL COMPANY, Dhahran (SA)

(72) Inventors: Qiuguo Li, Dhahran (SA); Khaqan Khan, Dhahran (SA); Augustine Ikenna Monyei, Abqaiq (SA); Tariq Mahmood, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/810,208

(22) Filed: Jun. 30, 2022

(65) Prior Publication Data

US 2024/0003194 A1 Jan. 4, 2024

(51) Int. Cl.

| | |
|---|---|
| ***E21B 12/02*** | (2006.01) |
| ***E21B 44/02*** | (2006.01) |
| ***E21B 49/00*** | (2006.01) |

(52) U.S. Cl.

CPC ..... *E21B 12/02* (2013.01); *E21B 44/02* (2013.01); *E21B 49/003* (2013.01)

(58) Field of Classification Search

CPC ..... E21B 12/02

See application file for complete search history.

(56) References Cited

U.S. PATENT DOCUMENTS

| | | | | |
|---|---|---|---|---|
| 6,386,297 | B1 | 5/2002 | Cooley et al. | |
| 8,274,399 | B2 | 9/2012 | Strachan et al. | |
| 10,282,497 | B2 | 5/2019 | Samuel et al. | |
| 11,066,917 | B2 | 7/2021 | Jain et al. | |
| 2017/0004235 | A1* | 1/2017 | Samuel | E21B 12/02 |
| 2022/0316328 | A1* | 10/2022 | Srivastava | E21B 49/003 |

FOREIGN PATENT DOCUMENTS

| | | | |
|---|---|---|---|
| CN | 102900372 A | * | 1/2013 |
| CN | 103306672 A | | 9/2013 |
| CN | 102900372 B | | 5/2014 |

OTHER PUBLICATIONS

IADC Dull Grading for PDC bits. (Year: 1992).*
CN 102900372 A Translation of Description (Year: 2023).*

(Continued)

*Primary Examiner* — Giovanna Wright
(74) *Attorney, Agent, or Firm* — Osha Bergman Watanabe & Burton LLP

(57) ABSTRACT

Systems and methods for predicting drill bit wearing state using drilling parameters and formation properties are disclosed. The methods include, for each of a plurality of past bit runs, obtaining a measured rock property value and a measured drilling variable value for the past bit run, and obtaining a measured dull grade for a drill bit used for the past bit run. The methods also include determining parameters of a functional relationship between the measured dull grade, the bit run time, the measured rock property value, and the measured drilling variable value, and predicting a predicted dull grade for a future bit run using a new drill bit. The methods further include replacing the new drill bit with a replacement drill bit at a time based, at least in part, on the predicted dull grade.

14 Claims, 7 Drawing Sheets

(56) References Cited

OTHER PUBLICATIONS

CN 102900372 A Translation of Claims (Year: 2023).*
Liu, Yu et al., "Real-Time Bit Wear Monitoring and Prediction Using Surface Mechanics Data Analytics: A Step Toward Digitization Through Agile Development"; Proceedings of the IADC/SPE Drilling Conference and Exhibition; Paper No. IADC/SPE-189602-MS; pp. 1-9; Mar. 6, 2018 (9 pages).

* cited by examiner

METHOD FOR PREDICTING ROCK FORMATION ABRASIVENESS AND BIT WEAR

BACKGROUND

Drilling performance is inversely proportional to the state of wear of a drill bit. Trips for changing drill bits increase the total cost of drilling in addition to the cost of drill bits. Hence, predicting the wearing state of a drill bit while drilling in rock formations can help determine when to change a drill bit, thereby lowering costs. Furthermore, knowing the wearing state of the drill bit can diagnose the causes of poor drilling rate and more accurately predict the rate of penetration (ROP) under certain drilling conditions.

The wearing rate of a drill bit depends on multiple factors including the weight on the drill bit, the drill bit's rotary speed, and most importantly, the abrasiveness of subsurface formations. Drilling performance in hard and abrasive clastic reservoirs may lead to a slow rate of penetration (ROP), low bit-running hours, low drilled footage per bit, and a high cost per foot of drilling. Knowledge of formation abrasiveness, therefore, can help optimize the placement of a borehole for minimizing the drill bit wear.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments related to methods for predicting a drill bit wearing state using drilling parameters and formation properties are disclosed. The methods include, for each of a plurality of past bit runs, obtaining a measured rock property value and a measured drilling variable value for the past bit run, and obtaining a measured dull grade for a drill bit used for the past bit run. The methods also include determining parameters of a functional relationship between the measured dull grade, the bit run time, the measured rock property value, and the measured drilling variable value, and predicting a predicted dull grade for a future bit run using a new drill bit. The methods further include replacing the new drill bit with a replacement drill bit at a time based, at least in part, on the predicted dull grade.

In general, in one aspect, embodiments related to a non-transitory computer readable medium storing instructions executable by a computer processor with functionality for predicting drill bit wearing state using drilling parameters and formation properties are disclosed. The instructions include functionality for receiving a measured rock property value and a measured drilling variable value for the past bit run for each of a plurality of past bit runs, and receiving a bit run time and a measured dull grade for a drill bit used for the past bit run for each of a plurality of past bit runs. The instructions further include functionality for determining parameters of a functional relationship between the measured dull grade, the bit run time, the measured rock property value, and the measured drilling variable, and predicting a predicted dull grade for a future bit run using a new drill bit.

In general, in one aspect, embodiments related to a system configured for predicting drill bit wearing state using drilling parameters and formation properties are disclosed. The system includes a borehole, a drill bit to increase a length of the borehole, a drilling system attached to the drill bit, and a computer system. The system is configured to receive a measured rock property value and a measured drilling variable value for the past bit run for each of a plurality of past bit runs, and receive a bit run time and a measured dull grade for a drill bit used for the past bit run for each of a plurality of past bit runs. The system is also configured to determine parameters of a functional relationship between the measured dull grade, the measured rock property value, and the measured drilling variable, and predict a predicted dull grade for a future bit run using a new drill bit. The drilling system is further configured to convey and activate the drill bit and replace the new drill bit with a replacement drill bit at a time based, at least in part, on the predicted dull grade.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to a method for predicting drill bit wearing state using drilling parameters and formation properties. The method establishes a relationship between bit wear and weight-on-bit, drill bit rotary speed and rock abrasiveness. Rock abrasiveness is further related to several mineralogical, textural, and mechanical properties. These two relationships are combined and coefficients are determined through multiple linear regression based on measurement of drilling parameters, bit records, and interpreted formation properties.

With the determined coefficients, the bit wear model and the formation abrasiveness model may subsequently be applied to predict rock abrasiveness and bit wear for new drill bits, assuming some drilling parameters to be used and certain bit running hours. Further still, the predicted bit wear may be combined with a rate of penetration prediction model to predict the penetration rate and potential bit footage for a new bit.

Figure 1:
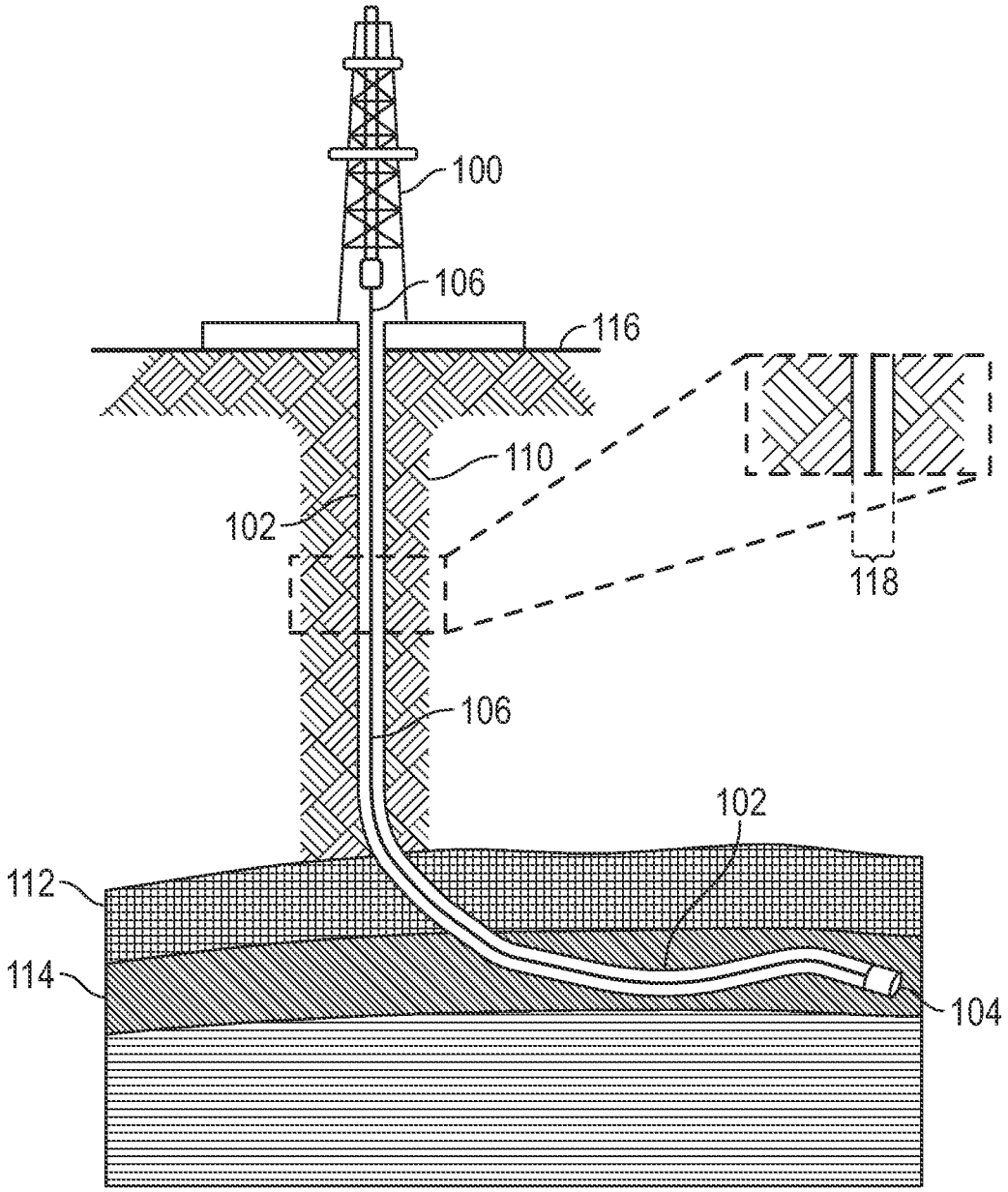
FIG. 1 shows a drilling system in accordance with one or more embodiments.

FIG. 1 illustrates systems in accordance with one or more embodiments. Specifically, FIG. 1 shows a well (102) that may be drilled by a drill bit (200) attached by a drillstring (106) to a drill rig (100) located on the surface of the earth (116). The "borehole" (118) corresponds to the uncased portion of the well (102). The borehole (118) of the well may traverse a plurality of overburden layers (110) and one or more cap-rock layers (112) to a hydrocarbon reservoir (114). Drill bits of many different designs may be used to drill boreholes. For example, polycrystalline diamond compact (PDC) drill bits (200) have proved to be effective and are a common choice for drilling through overburden layers (110), cap-rock layers (112), and into a hydrocarbon reservoir (114). However, the embodiments disclosed herein are not limited to PDC drill bits (200) or to any other specific type of drill bit (200). In other words, embodiments disclosed herein may apply to any suitable drill bit for drilling into formations below the Earth's surface.

Figure 2:
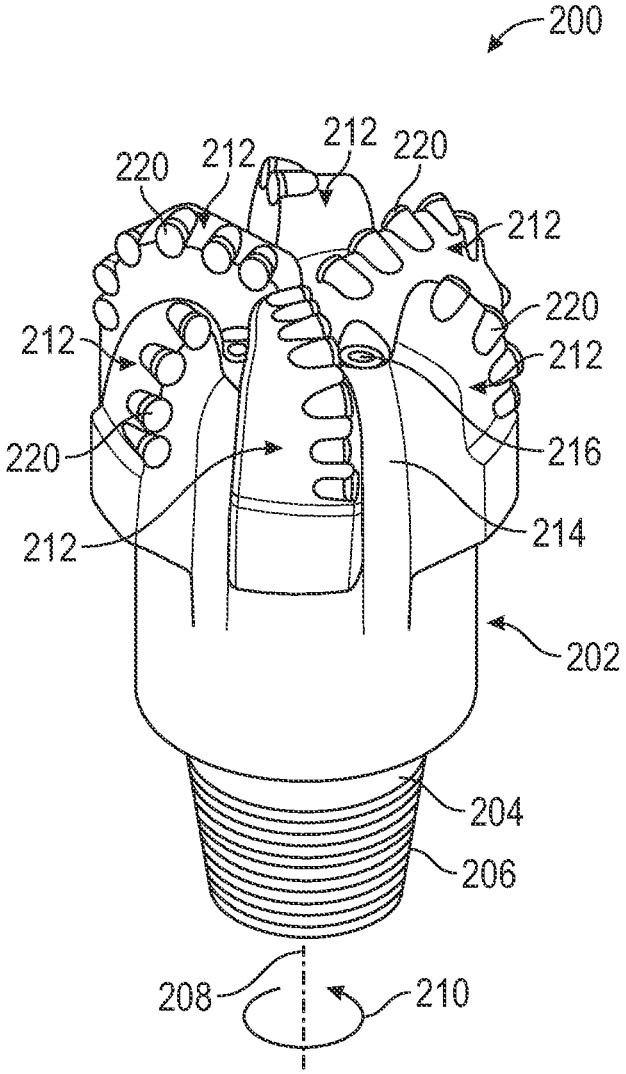
FIG. 2 shows a drill bit fitted with cutters.

FIG. 2 shows the features of an example fixed cutter drill bit (200) fitted with PDC cutters (220) for drilling through formations of rock formations to form a borehole (118) in accordance with one or more embodiments. The drill bit (200) has a bit body (202) rigidly connected to a central shank (204) terminating in a threaded connection (206) for connecting the drill bit (200) to a drillstring (106) to rotate the drill bit (200) in order to drill the borehole (118). The drill bit (200) has a central axis (208) about which the drill bit (200) rotates in the cutting direction represented by arrow (210).

In accordance with one or more embodiments, the cutting structure which is provided on the drill bit (200) includes six angularly spaced apart blades (212). In some embodiments, these blades (212) may be identical to each other, and in other embodiments these blades (212) may include a plurality of different blade types or designs. These blades (212) each project from the bit body (202) and extend radially out from the axis (210). The blades (212) are separated by channels that are sometimes referred to as junk slot (214) or flow courses. The junk slots (214) allow for the flow of drilling fluid supplied down the drillstring (106) and delivered through apertures (216), which may be referred to as nozzles or ports. Flow of drilling fluid cools the PDC cutters (220) and as the flow moves uphole, carries away the drilling cuttings from the face of the drill bit (200). Those skilled in the art will appreciate that while FIG. 2 shows six (6) blades, any suitable number of blades may be used in the cutting structure of embodiments disclosed herein.

In accordance with one or more embodiments, the blades (212) have pockets or other types of cavities which extend inwardly from open ends that face in the direction of rotation (210). PDC cutters (220) are secured by brazing in these cavities formed in the blades (212) so as to rotationally lead the blades and project from the blades, which exposes the cutting faces of the PDC cutters (220) as shown. According to one or more embodiments, the number of cutters (220) on each blade (212) may be identical; alternatively, the number of cutters (220) may be different on some blades (212) from other blades (212). Similarly, according to one or more embodiments, the position of cutters (220) on each blade (212) may be identical or may be different on some blades (212) from other blades (212).

Continuing with FIG. 2, the drill bit (200) is designed, in accordance with one or more embodiments, to increase the length of the borehole (118) by breaking the rock formation below or in front of the drill bit (200). In accordance with other embodiments, the drill bit (200) may be designed to increase the diameter of a pre-existing borehole (118) by breaking the rock formation which forms the walls of the pre-existing borehole (118). This process of increasing the diameter of a pre-existing borehole (118) may be called reaming, and the drill bit (200) used for reaming may be called a reamer. Reaming may be used to enlarge a section of a hole if the hole was not drilled as large as it should have been at the outset. This can occur when a drill bit (200) has been worn down from its original size but has been undetected until the drill bit (200) and drillstring (106) is removed from the borehole (118). Reamer drill bit may also have PDC cutters (220) mounted in their blades (212).

The wearing state of the drill bit (200) affects the drilling rate at which the drill rig (100) drills the borehole (118). The more the drill bit (200) is used, the duller or blunter the drill bit (200) becomes. A dull drill bit (200) has a lower rate of penetration (ROP) all other factors being equal. The dullness of the drill bit (200) is known as the "dull grade". The dull grade, D, is assumed to be dependent on a plurality of variables related to the drill rig (100) and a plurality of variables related to the subsurface rock properties. For example, dull grade D may be the product of a constant, drilling parameters and abrasiveness. This value is defined to lie in a range between 0 and 8, with 0 representing a brand-new bit and 8 a completely worn bit. This range may be translated to "sharp," "worn," "degraded," etc. The plurality of variables related to the drill rig (100) is referred to herein as the "drilling variables." The plurality of variables related to the subsurface rock properties will be referred to as the "rock property variables."

The drilling variables may include weight-on-bit (WOB), $W_b$, a bit rotary speed, N, or rate of penetration (ROP). The WOB is the force applied to the drill bit (200) coming from the weight of the drillstring (106) and fluid in the borehole that pushes the drill bit (200) from behind into the rock as it drills. The rock property variables comprise a rock grain size, T, a volume of quartz within the rock, $V_q$, a rock strength, $\xi_c$, a porosity, $\phi_t$, and a water saturation, $\eta$. The rock property variables may be aggregated into a single variable called a formation abrasiveness (or simply, "abrasiveness"), A.

The dull grade, D, depends on the drilling parameters, the bit run time, and the formation abrasiveness in the following way:

$$D=f_1W_b^aN^bA^cH^d, \tag{1}$$

where the exponents, a, b, c, d, and the pre-exponential factor, $f_1$, are coefficients to be determined from a collection of data.

The abrasiveness, A, is dependent on the rock property variables through the following equation:

$$A=f_2T^eV_q^g\xi_c^h\phi_t^i\eta^j, \tag{2}$$

where the exponents, e, g, h, i, j, and the pre-exponential factor, $f_2$, are again coefficients that must be determined from the collection of data. Typically, the formation abrasiveness increases with the relative rock grain size, the volume of quartz, and the rock strength, and decreases with the porosity and the water saturation.

Equations 1 and 2 may be combined to give:

$$D=f_3 W_b^a N^b H^d T^e V_q^g \xi_c^h \phi_t^i \eta^j \quad (3)$$

As above, the exponents, a, b, c, d, e, g, h, i, j, and the pre-exponential factor, $f_3$, are coefficients to be determined from data by a data-fitting method. Given that both the dull grade, D, and the abrasiveness, A, are modeled as exponential functions of their dependent variables, taking the logarithm of both dependent and independent variables will result in a linear relationship between the dependent variables and the logarithm of the independent variable:

$$\log(D)=\log(f_3)+a \log W_b\ b \log(N)+d \log(H)+e \log(T)+g \log(V_q)+h \log(\xi_c)+i \log(\phi_t)+j \log(\eta) \quad (4)$$

This simplifies the data fitting and allows for multiple linear regression techniques to be used to determine the coefficient associated with each dependent variable. After calculating a set of coefficients through multiple linear regression, the coefficients may then be used in at least two ways. In some embodiments, the set of coefficients may be used to predict a rock abrasiveness of subsurface rocks by using equation (2), when given new values of T, $\xi_c$, $V_q$, $\phi_t$, and $\eta$, acquired during another drilling operation in the same field and when using a new drill bit of the same type and manufacturer. In other embodiments, the set of coefficients may be used to predict the dull grade of the drill bit (200) by using equation (3), given new values of $W_b$, N, H, and A acquired during another drilling operation in the same field when using a new drill bit of the same type and manufacturer. These predictions, in turn, allow a drilling manager, operator, or other person in charge of the drilling operation to predict a drilling footage for a new drill bit (200) along with its longevity. "Drilling footage" is the distance a drill bit (200) can drill into the subsurface before it needs to be retrieved due to bit wear.

Figure 3:
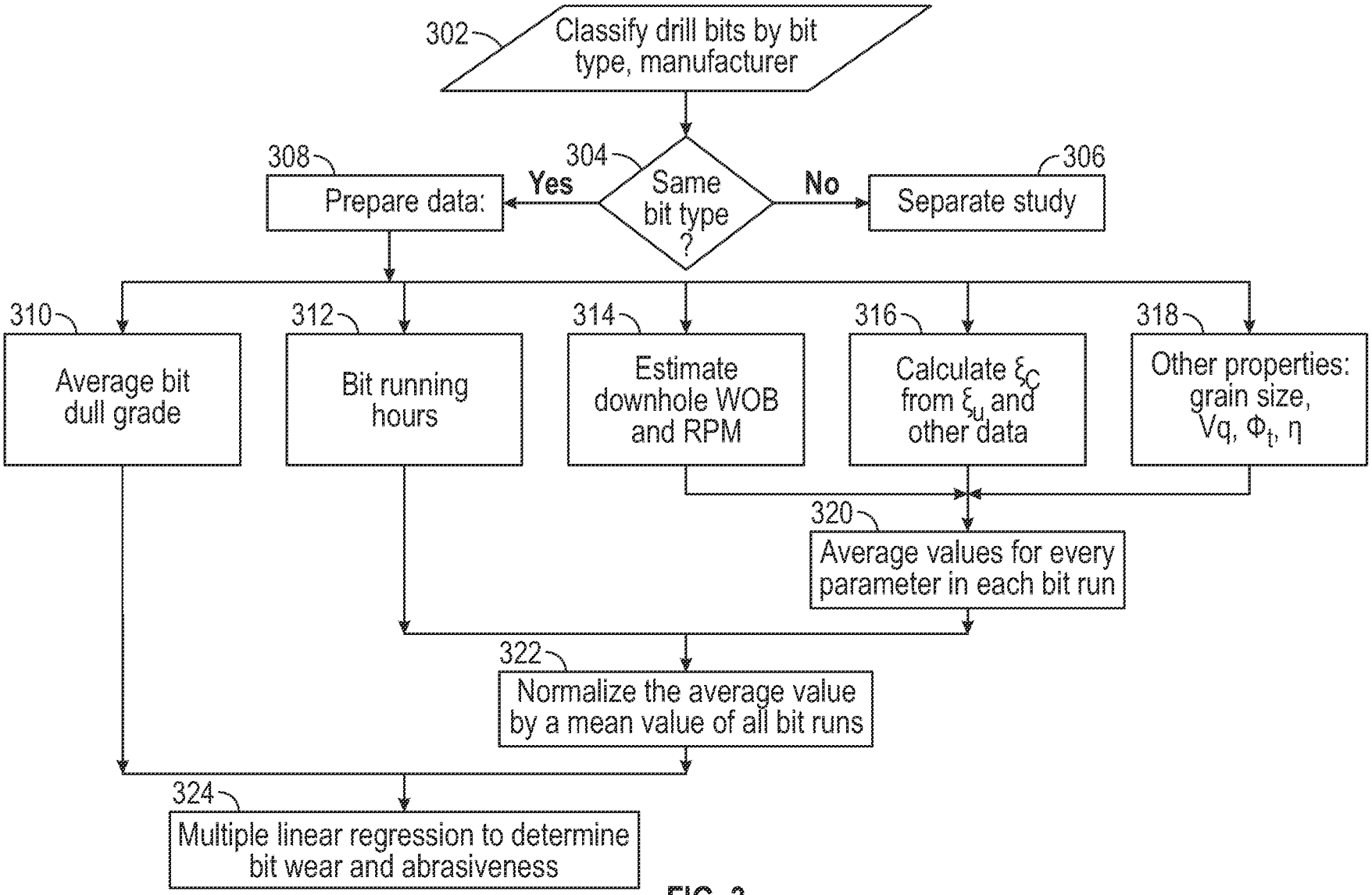
FIG. 3 shows a flowchart for a method that predicts rock formation abrasiveness and drill bit wear according to one or more embodiments.

FIG. 3 shows a flowchart of the method for predicting the dull grade, D, of a drill bit (200) and the abrasiveness of a rock formation, A. In Step 302, the type of drill bit is classified according to its type and manufacturer. There are many types of drill bits used in the oil and gas industry that may be categorized both by their function or their construction. While the most common function of a drill bit, such as a "primary drill bit," is to extend the length of a wellbore by drilling a bore with a diameter slightly greater than the diameter of the drill bit, other drill bits perform specialized functions. For example, coring drill bits have a central hole in the cutting face that does not bore the rock, unlike the annulus around this central hole. As a result, a cylindrical column of rock may be formed and pass through the central hole to be retrieved as a cylindrical core sample within a "core catching" barrel within the bottomhole assembly to which the coring drill bit is attached. Other drill types, such as eccentered or bi-centered drill bits are used to form a wellbore with a diameter that is significantly larger than the diameter of the drill bit. Eccentered drill bits are designed to move in the plane perpendicular to the wellbore axis in a whirling or oscillatory manner Still other types of drill bits, often called "reamers" are designed only to increase the diameter of a preexisting wellbore and may be deployed either on the drillstring behind a primary drill bit or may be deployed stand-alone, after a portion of wellbore has been drilled by a different drill bit.

Drill bits may also be categorized by their construction. Roller cone (or "tricone") drill bits type are a common type of bit used in oil and gas fields. The cutting action is provided by cones that have either steel teeth or tungsten carbide inserts. These cones rotate on the bottom of the hole and drill hole predominantly with grinding and chipping action. Rock bits are classified as milled tooth bits or insert bits depending on the cutting surface on the cones. The cones of a roller cone bit are mounted on bearing pins which extend from the bit body along axes angled with respect to one another. The bearings allow each cone to turn about its own axis as the bit is rotated.

In contrast to roller cone bits, diamond bits contain a matrix (typically steel, or a steel alloy) structure in which diamonds are embedded and fluid pathways from the interior to the exterior of the bit. Drilling fluid should flow across the face of the bit to clean the cuttings and cool the diamonds. The rock failure mechanism with a diamond bit is different from roller cone bits. The diamond is embedded in the formation and then dragged across the rock face to produce a scraping action.

While some diamond bits use natural diamonds, synthetic diamond bits are far more common. The synthetic diamond bit (200), called polycrystalline diamond compact (PDC) bit consist of banks of cutters (220) made of a layer of polycrystalline, man-made diamond, and cemented tungsten carbide embedded in steel matrix blades (212). The resulting cutter has nearly the hardness of natural diamond and a greater abrasion resistance and is complemented by the strength and impact resistance of cemented tungsten carbide.

This description of the form and function of drill bit is intended only as a broad overview and in no way should be interpreted as limiting the scope of the invention. Further, each of the categories mentioned may be manufactured in many different variants. For example, the size, number, shape, and orientation of the PDC cutters (220) may vary from one design and one manufacturer to another.

In Step 304, it is determined whether or not the current drill bit is the same as a drill bit (200) that had been used previously in the same field and from which data for all the variables in equations 2 and 3 had been collected. The drill bit (200) that was used previously in drilling runs in the same field is referred to herein as a "past drill bit." The drill bit (200) that is currently being used in drilling runs is referred to herein as the "current drill bit." In one or more embodiments if the current drill bit is not of the same type and from the same manufacturer as the past drill bit, different data may be required from a separate study before applying the method (306). If the current drill bit is of the same type and from the same manufacturer as the past drill bit, the data from the past bit records is prepared for processing (308).

The term "bit records" refers to information obtained from a bit run, comprising the dull grade (310), D, along with other bit data and some of the drilling variables used in the bit run (312, 314), e.g., $W_b$, H, and N. More detailed drilling variables with finer resolution are available from either surface measurement or downhole measurement. Values for the rock property variables (316, 318), T, $\xi_c$, $V_q$, $\phi_t$, and $\eta$ are derived from wireline logs or logging-while-drilling (LWD) data based on established models. A "bit run" begins when a new drill bit (200) is placed at the end of the drillstring (106) down into the well (102) and ends when the worn drill bit (200) is retrieved. In practice, the drill bit may only be inspected at the end of the bit run. For each bit run of a past drill bit, based on the starting depth and end depth, the following data may be averaged (320): rock grain size, T, rock strength, $\xi_c$, quartz content, $V_q$, porosity, $\phi_t$, water saturation, q, weight-on-bit, $W_b$, and drill bit (200) rotary speed, N. The result of the averaging process is that there are a number of data points for each of the variables in equation 3 equal to the total number of past drill bit runs. Each variable's average value may be, in turn, averaged across all bit runs and normalized by that average value over all bit runs (322) in all wells analyzed. For example, the rock grain size value for each bit run may be normalized by the average rock grain size determined for all the bit runs. Running time, H, is the amount of time a drill bit is used in drilling the formation rocks and thus has one value per bit run. H is also normalized by its average value across all bit runs. The dull grade, D, is obtained during each bit run from physically inspecting the drill bit (200) when it is retrieved from the well (102). The dull grade is measured on both the inner and outer cutters (220) of the drill bit (200) and averaged to obtain the value of D for the bit run. The dull grade values from all the bit runs and the normalized values of each parameter from all the bit runs are entered into the multiple linear regression calculation (324).

The individual measured values of the drilling parameters recorded in the bit records for each bit run may be obtained as follows: The values of the WOB (314) may be measured by downhole sensors if they are available. However, most wells are not equipped with downhole sensors. The WOB at the drill bit is approximately the same as surface-measured WOB if the well is vertical. If a wellbore is deviated or horizontal, the WOB at the drill bit (200) is lower than the surface-measured weight-on-bit. The downhole weight-on-bit may be calculated with equation 5:

$$W_b = We^{-\mu\gamma}, \tag{5}$$

where $W_b$ is downhole weight-on-bit, W, is the surface-measured weight-on-bit, $\mu$ is friction between drill pipe and wellbore, and $\gamma$ is well inclination angle.

In one particular embodiment, the values of drill bit rotary speed, N, (314) can be estimated from the surface-measured revolutions per minute (RPM) of the drillstring and the revolutions per minute of a hydraulically driven motor ("mud-motor") such as the mud-motors used in rotary steerable systems (RSS), if it is included in the bottomhole assembly (BHA). Alternatively, the drill bit rotary speed (314) may be measured downhole. Due to the friction between the drillstring and the wellbore and possibility of stick-slip, the surface-measured rotary speed is not synchronized with the drill bit rotary speed, which makes the downhole-measured bit rotary speed much more accurate. Rotary speed may be measured and recorded in any units familiar to any person with ordinary skill in the art.

The measured values of the rock property variables during each bit run are obtained as follows: Rock texture, represented by rock grain size values, is not readily available in most cases but may be calculated from spectroscopy gamma ray well logs (318), using the following equation:

$$T = 20 - 19.9\frac{\log 10CGR - \log 10CGR_{min}}{\log 10CGR_{max} - \log 10CGR_{min}}, \tag{6}$$

where CGR is the total corrected gamma ray values of potassium and thorium. $CGR_{max}$ is the maximum CGR value in clay rich formations and $CGR_{min}$ is the minimum CGR value in quartz rich formations.

Rock at the drill bit (200) location in the subsurface is under the differential pressure between mud pressure and pore pressure. Rock strength (316) under a differential pressure is known as "confined compressive strength," $\xi_c$, and has a higher value than if it were unconfined.

$\xi_c$ may be determined based on the unconfined compressive stress, $\xi_u$, the friction angle, $\psi$, and the confining pressure, $d_p$, on the rock ahead of the drill bit. The confining pressure may be calculated differently in formations of different permeability. In permeable formations, the confining pressure on the rock ahead of the bit is equivalent to the difference between the wellbore pressure and pore pressure. In impermeable formations, the pore pressure in the rock ahead of the drill bit may decrease due to stress release and rock expansion. The reduction in pore pressure is a function of the in-situ earth stress in the direction of drilling and the Skempton pore pressure coefficient. The effective confining pressure may be greater than the differential pressure between the well pressure and pore pressure.

In accordance with some embodiments, a formation is considered permeable if the effective porosity is greater than 0.2 and impermeable if the effective porosity is less than 0.05. Equation 7 to Equation 10 show the confined compressive stress and confining pressure calculation for permeable and impermeable formations, respectively. In the case of a permeable formation (greater than 0.2), we have $$\xi_{cdp} = \xi_u + d_p + 2d_p\frac{\sin\psi}{1 - \sin\psi}, \tag{7}$$

where the confining pressure is calculated by $$d_p = P_w - P_p. \tag{8}$$

In the case of an impermeable formation, we have $$\xi_{csk} = \xi_u + d_{psk} + 2d_{psk}\frac{\sin\psi}{1 - \sin\psi}, \tag{9}$$

where the confining pressure is calculated by $$d_{psk} = P_w - P_p + \frac{B(\sigma_n - P_w)}{3}. \tag{10}$$

In formations with an effective porosity between 0.05 and 0.2, the confined compressive strength is interpolated between the permeable case and the impermeable case. Equation 11 shows calculation of confined compressive stress for formations with porosity in this range:

$$\xi_{cmix} = \frac{\xi_{cdp}(\phi_e - 0.05) + \xi_{csk}(0.2 - \phi_e)}{0.15}. \tag{11}$$

Combining equations 7 and 9, $\xi_c$ will equal either $\xi_{csk}$, $\xi_{cmix}$, or $\xi_{cdp}$, depending on the formation permeability:

$$\begin{aligned}\xi_c &= \xi_{cdp} \text{ if } \phi_e \geq 0.2,\\ &= \xi_{csk} \text{ if } \phi_e \leq 0.05\\ &= \xi_{cmix} = \frac{\xi_{cdp}(\phi_e - 0.05) + \xi_{csk}(0.2 - \phi_e)}{0.15} \text{ if } 0.05 < \phi_e \leq 0.2\end{aligned}$$

where:

$\xi_{cdp}$=confined compressive strength in permeable formation, psi $\xi_{csk}$=confined compressive strength in impermeable formation, psi $\xi_{cmix}$=confined compressive strength in formations of intermediate porosity, psi $\xi_u$=unconfined compressive strength, psi $\sigma_n$=earth stress normal to the bottom of a wellbore, psi $d_p$=differential pressure between the wellbore and the pore pressure ahead of the drill bit where the formation is permeable, psi $d_{psk}$=differential pressure between the wellbore and the pore pressure ahead of the drill bit where the formation is impermeable, psi $P_p$=pore pressure, psi $P_w$=well pressure, psi $\phi_e$=effective porosity, dimensionless B=Skempton pore pressure coefficient, dimensionless.

The values of $V_q$, $\phi_t$, and $\eta$ may be obtained from petrophysical interpretation of wireline or LWD logs. In such interpretations, petrophysicists may use multiple well logs to provide the fractional volumes (and weights) of all major minerals in the rock, total and effective porosities, permeability, water saturation and other parameters. Often, the model is calibrated using core, production, well test, and other datasets.

Once the averaged and normalized values of dependent and independent variables from each bit run have been prepared (308), the logarithm of each of the values is calculated; the log-transformed data can then be entered into a multiple linear regression equation (324). Solving this equation returns the values of the coefficients a, b, d, e, g, h, i, j, and $f_3$. With the values of these coefficients, the multiple linear equation can be used to predict the dull grade and abrasiveness in new drilling operations in the same reservoir of the same field when using the same type of drill bit from the same manufacturer. During a new bit run in a new well, a single new value will be produced for each of $W_b$, N, T, $V_q$, $\xi_c$, $\phi_t$, $\eta$, and H through the above averaging and normalizing process. These values can be input into equation (3) to predict a new value for D. Similarly, equation (2), with coefficients e, g, h, i, j, and $f_2$ will give a prediction of the rock abrasiveness, A, at the new drilling location in the same reservoir of the same field. The predicted dull grade can be combined with an estimated rate of penetration to predict the ROP with bit wear taken into consideration and drill bit footage for the new bit before it needs to be retrieved from the well. It also may be used to predict the longevity of the drill bit (200).

An example of the application of one embodiment is now described. This description is for illustrative purposes only and should not be interpreted as limiting the claimed invention. During development of a field, several wells (102) may be drilled into the subsurface. Spectroscopy gamma ray and other well logs may be recorded using LWD or wireline logging techniques. Equation (6) is used to take the spectroscopy gamma ray data and calculate the rock grain size, T, at each point in the well (102) that the drill bit (200) traverses while drilling. Downhole weight-on-bit, $W_b$, if not available, can be estimated at all points along the path of the drill bit using the surface weight-on-bit and well inclination data. With the estimated or measured drill bit rotary speed and other interpreted formation properties, the multiple values for $W_b$, N, T, $V_q$, $\xi_c$, $\phi_t$, and $\eta$ are averaged for each bit run; another average is taken across all bit runs and the values of all the parameters for each bit run are normalized by this average value across all bit runs. The bit run time, H, is also recorded once per bit run. It is also normalized by its average value across all bit runs. Thus, only one averaged and normalized value for each variable exists per bit run. A single value of the dull grade, D, is also obtained for each bit run by averaging the measured dull grade of the inner and outer cutters (220) upon extraction of the drill bit (200) at the end of the bit run. After several bit runs, the values of the dependent and independent variables in equation (3) can be used to construct the multiple linear regression equation to estimate the coefficients. Data from existing offset wells which were drilled in the same formation layers with the same type of drill bits can also be used in this process. The larger the number of bit runs averaged in this step, the greater the confidence the operator may have in the estimated coefficients. The estimated coefficients may include error or confidence estimates and may be represented as probability distributions. Once obtained, the coefficients allow for prediction of both formation abrasiveness and dull grade during a new drilling operation. In this case, while drilling is actively occurring, log data are being collected. The variables, W, N, T, V, $\xi_c$, $\phi_t$, $\eta$, and H, are measured during the active drilling process. Averaging them gives a single value for each of the new active bit run. These average values are normalized by the average value across all bit runs. Plugging these averaged and normalized values into the multiple linear regression equation allows a dull grade and a formation abrasiveness to be predicted using equations (3) and (2), respectively.

The estimated dull grade value may help the operator decide when to end the bit run and extract the drill bit (200). It also allows a prediction of the total footage of drilling that may be accomplished before the drill bit (200) must be extracted and replaced. The estimated formation abrasiveness gives information to the operator about the physical properties of the formation that is being drilled through.

Figure 4:
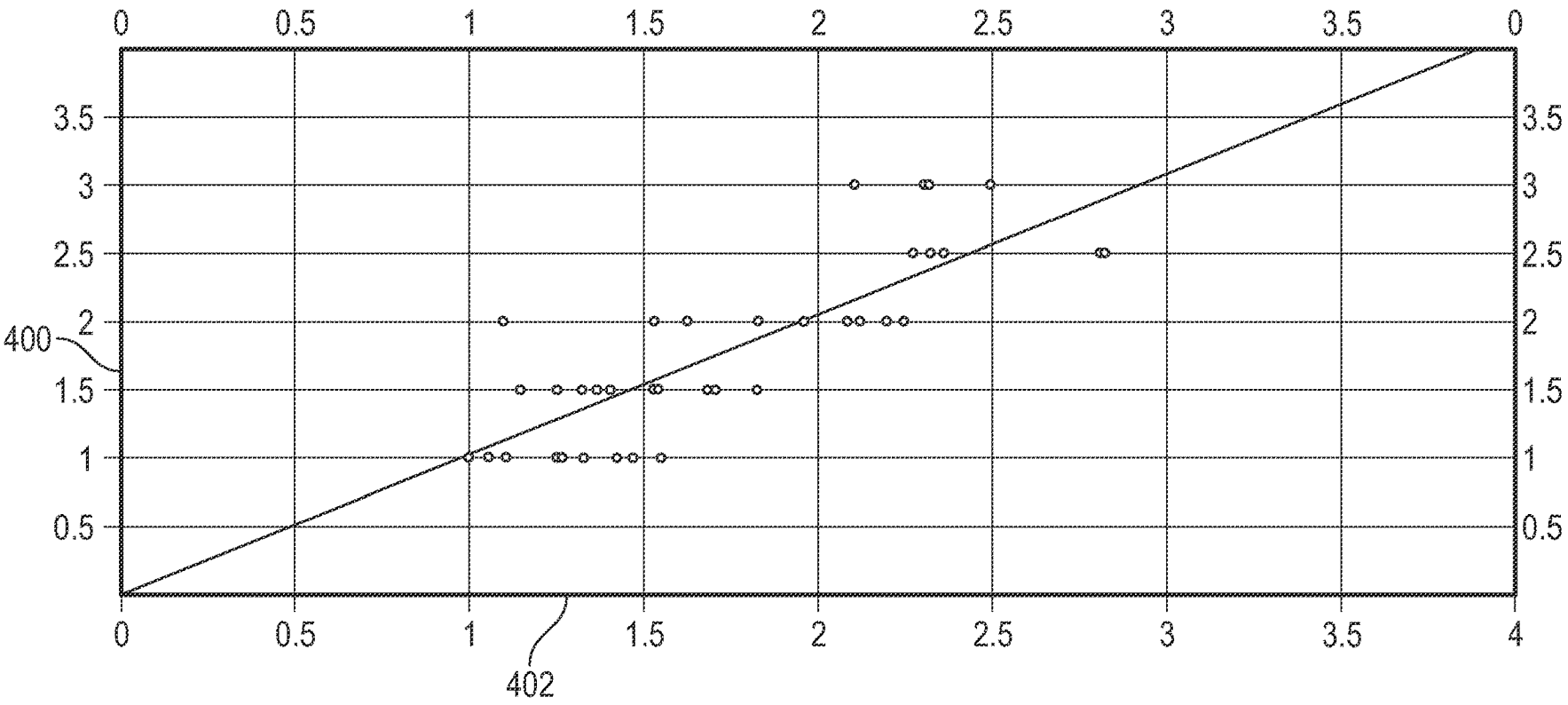
FIG. 4 shows a cross plot of measured versus predicted dull grade according to one or more embodiments.

FIG. 4 shows a cross plot of the measured dull grade, indicated on the vertical axis (400) and the predicted dull grade, indicated on the horizontal axis (402) for a plurality of drill bits (200) after applying the method described in FIG. 3 for one type of bit made by one drill bit manufacturer. There is a good match between the measured dull grade (DG) (400) and the predicted dull grade (DG_REG) (420).

Figure 5:
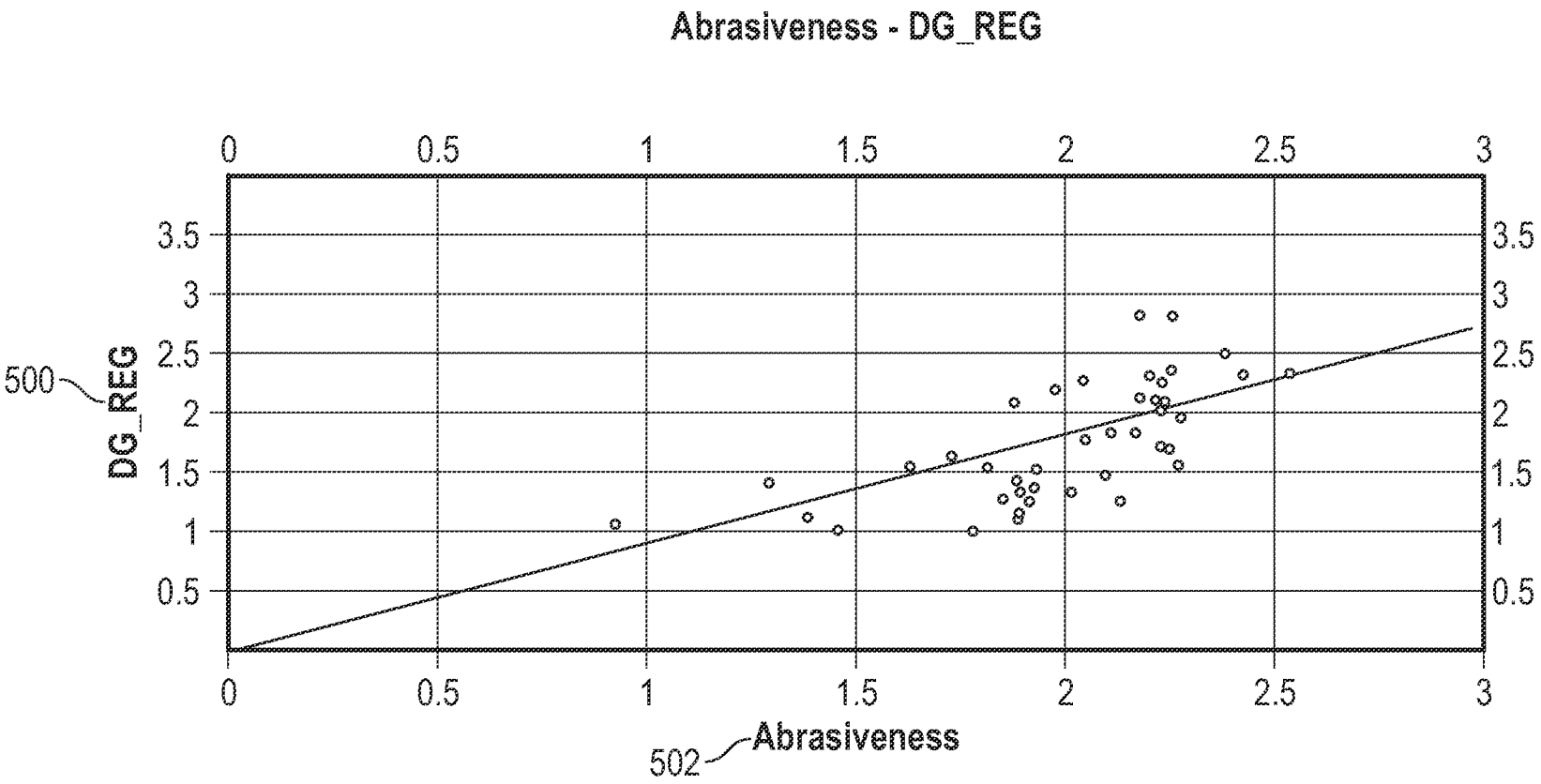
FIG. 5 shows a cross plot of predicted dull grade versus predicted formation abrasiveness according to one or more embodiments.

FIG. 5 shows a cross plot of the predicted dull grade (DG_REG, 500) and the predicted formation abrasiveness (502). A dependent relationship between these two quantities can be seen where, as the formation abrasiveness increases, the dull grade of the drill bit (200) also increases.

Figure 6:
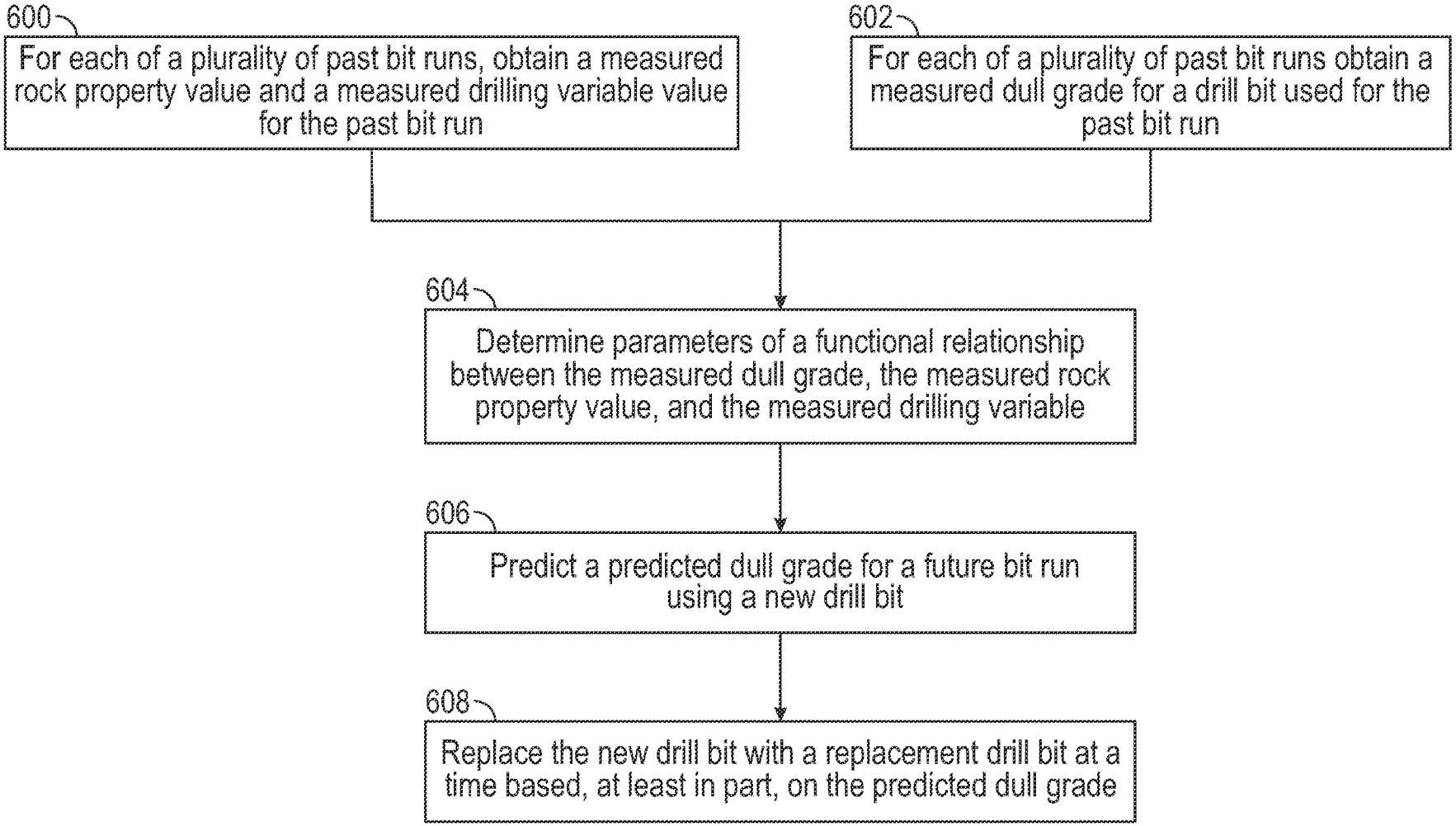
FIG. 6 shows a flowchart according to one or more embodiments.

FIG. 6 presents a workflow for the method. In Step 600, in accordance with one or more embodiments, for each of a plurality of past bit runs, a measured rock property variable value ("rock property value") and a measured drilling variable value ("drilling value") for the past bit run may be obtained. The rock property variable may be a rock texture, T, a volume of quartz, $V_q$, a rock strength, $\xi_c$, a porosity, $\phi_t$, or a water saturation, $\eta$. The drilling variable may be a weight-on-bit, $W_b$, or a drill bit rotary speed, N. The measured rock property value and the measured drilling value may be obtained by averaging values for the past drill bit (200) run and then normalizing by an average value across a plurality of past drill bit runs.

In Step 602, in accordance with one or more embodiments, for each of a plurality of past bit runs, a measured dull grade for a past drill bit (200) used for the past bit run may be obtained. The dull grade of the past drill bit (200) may be obtained by averaging the dull grade between the inner and outer cutters (220) of the past drill bit (200) upon completion of the past bit run and extraction of the past drill bit (200).

In Step 604, the parameters of a functional relationship between the measured dull grade, the measured rock property variable, and the measured drilling variable may be determined. The measured dull grade is the independent variable in equation 3 and the rock property variable and the measured drilling variables are the dependent variables. The functional relationship between independent and dependent variables may be determined by calculating the logarithm of the dependent and independent variables and performing multiple linear regression on the logarithms of the dependent and independent variables. Multiple linear regression may obtain the regression coefficients, a, b, d, e, g, h, i, j, and $f_3$, associated with equations 2 and 3.

Furthermore, a functional relationship between rock abrasiveness and the rock property variable may be determined, where the rock abrasiveness is the independent variable in equation 2 and the rock property variable is the dependent variable. The functional relationship between independent and dependent variables (in this case, the abrasiveness and the rock property variable) may be determined by calculating the logarithm of the dependent and independent variables and performing multiple linear regression on the logarithms of the dependent and independent variables.

In Step 606, during a new drilling operation, averaged and normalized values of dependent variables ($W_b$, N, T, $V_q$, $\xi_c$, $\phi_p$, $\eta$, and H) may be collected in a bit run at a new borehole (118) location. The regression coefficients may be used as exponents in equations 2 and 3 to predict a dull grade and a formation abrasiveness at the new borehole (118) location. The dull grade and formation abrasiveness may be used to estimate the drill bit (200) longevity and drilling footage of the current drill bit (200) at the new borehole (118) location.

In Step 608, the new drill bit (200) may be replaced with a replacement drill bit (200) at a time based, at least in part, on the predicted dull grade.

Drill bits (200) may be classified according to their type and manufacturer. In one or more embodiments, the method of FIG. 6 is to be applied to different types of drill bits (200) made by different manufacturers separately. If the current drill bit (200) is different than the past drill bit (200), the method cannot be applied until bit run data obtained for the current drill bit (200).

Figure 7:
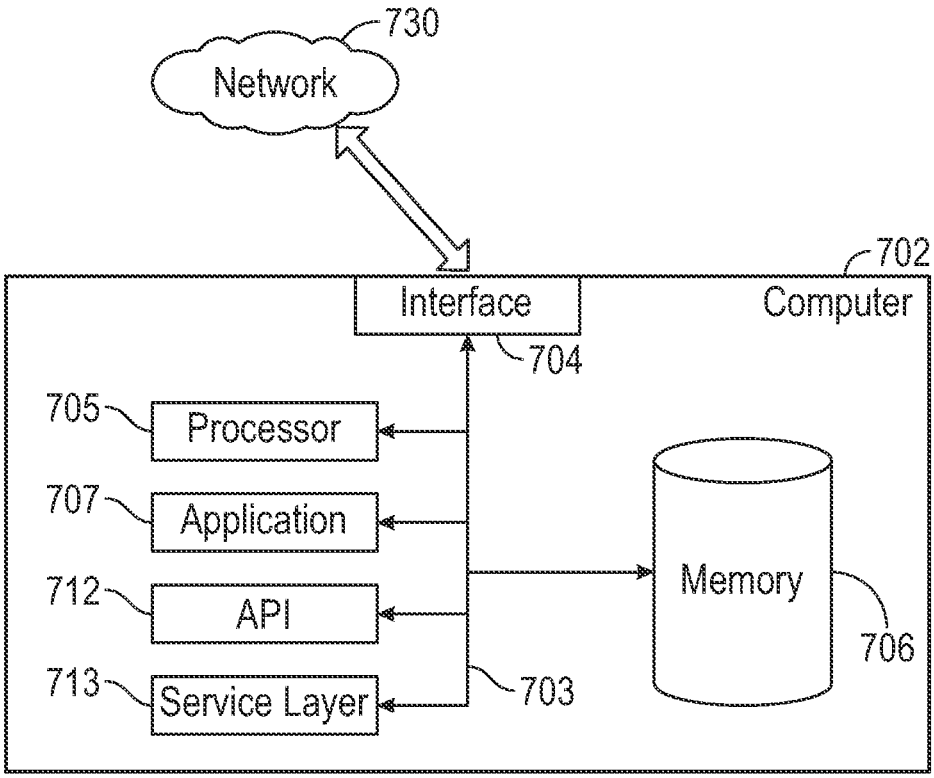
FIG. 7 shows a computing device according to one or more embodiments.

FIG. 7 further depicts a block diagram of a computer system (702) used to provide computational functionalities associated with described algorithms, methods, functions, processes, flows, and procedures as described in this disclosure, according to one or more embodiments. The illustrated computer (702) is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer (702) may include a computer that includes an input device, such as a keypad, keyboard, touch screen, or other device that can accept user information, and an output device that conveys information associated with the operation of the computer (702), including digital data, visual, or audio information (or a combination of information), or a GUI.

The computer (702) can serve in a role as a client, network component, a server, a database or other persistency, or any other component (or a combination of roles) of a computer system for performing the subject matter described in the instant disclosure. The illustrated computer (702) is communicably coupled with a network (730). In some implementations, one or more components of the computer (702) may be configured to operate within environments, including cloud-computing-based, local, global, or other environment (or a combination of environments).

At a high level, the computer (702) is an electronic computing device operable to receive, transmit, process, store, or manage data and information associated with the described subject matter. According to some implementations, the computer (702) may also include or be communicably coupled with an application server, e-mail server, web server, caching server, streaming data server, business intelligence (BI) server, or other server (or a combination of servers).

The computer (702) can receive requests over network (730) from a client application (for example, executing on another computer (702) and responding to the received requests by processing the said requests in an appropriate software application. In addition, requests may also be sent to the computer (702) from internal users (for example, from a command console or by other appropriate access method), external or third-parties, other automated applications, as well as any other appropriate entities, individuals, systems, or computers.

Each of the components of the computer (702) can communicate using a system bus (703). In some implementations, any or all of the components of the computer (702), both hardware or software (or a combination of hardware and software), may interface with each other or the interface (704) (or a combination of both) over the system bus (703) using an application programming interface (API) (712) or a service layer (713) (or a combination of the API (712) and service layer (713). The API (712) may include specifications for routines, data structures, and object classes. The API (712) may be either computer-language independent or dependent and refer to a complete interface, a single function, or even a set of APIs. The service layer (713) provides software services to the computer (702) or other components (whether or not illustrated) that are communicably coupled to the computer (702). The functionality of the computer (702) may be accessible for all service consumers using this service layer. Software services, such as those provided by the service layer (713), provide reusable, defined business functionalities through a defined interface. For example, the interface may be software written in JAVA, C++, or other suitable language providing data in extensible markup language (XML) format or another suitable format. While illustrated as an integrated component of the computer (702), alternative implementations may illustrate the API (712) or the service layer (713) as stand-alone components in relation to other components of the computer (702) or other components (whether or not illustrated) that are communicably coupled to the computer (702). Moreover, any or all parts of the API (712) or the service layer (713) may be implemented as child or sub-modules of another software module, enterprise application, or hardware module without departing from the scope of this disclosure.

The computer (702) includes an interface (704). Although illustrated as a single interface (704) in FIG. 6, two or more interfaces (704) may be used according to particular needs, desires, or particular implementations of the computer (702). The interface (704) is used by the computer (702) for communicating with other systems in a distributed environment that are connected to the network (730). Generally, the interface (704) includes logic encoded in software or hardware (or a combination of software and hardware) and operable to communicate with the network (730). More specifically, the interface (704) may include software supporting one or more communication protocols associated with communications such that the network (730) or interface's hardware is operable to communicate physical signals within and outside of the illustrated computer (702).

The computer (702) includes at least one computer processor (705). Although illustrated as a single computer processor (705) in FIG. 6, two or more processors may be used according to particular needs, desires, or particular implementations of the computer (702). Generally, the computer processor (705) executes instructions and manipulates data to perform the operations of the computer (702) and any algorithms, methods, functions, processes, flows, and procedures as described in the instant disclosure.

The computer (702) also includes a memory (706) that holds data for the computer (702) or other components (or a combination of both) that can be connected to the network (730). For example, memory (706) can be a database storing data consistent with this disclosure. Although illustrated as a single memory (706) in FIG. 6, two or more memories may be used according to particular needs, desires, or particular implementations of the computer (702) and the described functionality. While memory (706) is illustrated as an integral component of the computer (702), in alternative implementations, memory (706) can be external to the computer (702).

The application (707) is an algorithmic software engine providing functionality according to particular needs, desires, or particular implementations of the computer (702), particularly with respect to functionality described in this disclosure. For example, application (707) can serve as one or more components, modules, applications, etc. Further, although illustrated as a single application (707), the application (707) may be implemented as multiple applications (707) on the computer (702). In addition, although illustrated as integral to the computer (702), in alternative implementations, the application (707) can be external to the computer (702).

There may be any number of computers (702) associated with, or external to, a computer system containing computer (702), wherein each computer (702) communicates over network (730). Further, the term "client," "user," and other appropriate terminology may be used interchangeably as appropriate without departing from the scope of this disclosure. Moreover, this disclosure contemplates that many users may use one computer (702), or that one user may use multiple computers (702).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A method, comprising:

for each of a plurality of past bit runs:

obtaining a measured rock property value and a measured drilling variable value for a past bit run, and obtaining a measured dull grade for a past drill bit used for the past bit run;

determining parameters of a functional relationship between the measured dull grade, a bit run time, the measured rock property value, and the measured drilling variable value;

predicting a rate-of-penetration and a drill bit footage for a current drill bit, and a predicted dull grade for a future bit run using the current drill bit; and extracting the current drill bit for replacement with a replacement drill bit at a time based, at least in part, on the predicted dull grade.

2. The method of claim 1, further comprising predicting a predicted abrasiveness for the future bit run using the current drill bit.

3. The method of claim 1, wherein the current drill bit and the past drill bit are polycrystalline diamond compact (PDC) drill bits.

4. The method of claim 1, wherein the measured rock property value and a measured drilling value are obtained by averaging values for a drill bit run and then normalizing by an average value across a plurality of drill bit runs.

5. The method of claim 1, wherein the drilling variable comprises a weight-on-bit, or a drill bit rotary speed.

6. The method of claim 1, wherein the measured rock property variable comprises a rock texture, a volume of quartz, a rock strength, a porosity, or a water saturation.

7. The method of claim 1, wherein determining parameters of a functional relationship between independent and dependent variables comprises:

determining a logarithm of the dependent and independent variables; and performing multiple linear regression on the logarithm of the dependent and independent variables.

8. A system comprising:

a borehole;

a past drill bit to increase a length of the borehole;

a computer system, configured to:

receive a measured rock property value and a measured drilling variable value for a past bit run for each of a plurality of past bit runs, receive a measured dull grade and a bit run time for the past drill bit used for the past bit run for each of a plurality of past bit runs, determine parameters of a functional relationship between the measured dull grade, the bit run time, the measured rock property value, and the measured drilling variable, predict a predicted dull grade for a future bit run using a current drill bit, and predict a rate-of-penetration and a drill bit footage for the current drill bit; and a drilling system attached to the current drill bit configured to:

convey and activate the current drill bit, and extract the current drill bit for replacement with a replacement drill bit at a time based, at least in part, on the predicted dull grade.

9. The system of claim 8, further configured to predicting a predicted abrasiveness for a future bit run using the current drill bit.

10. The system of claim 8, wherein a current drill bit and the past drill bit are polycrystalline diamond compact (PDC) drill bits.

11. The system of claim 8, wherein the measured rock property value and a measured drilling value are obtained by averaging values for a drill bit run and then normalizing by an average value across a plurality of drill bit runs.

12. The system of claim 8, wherein the drilling variable comprises a weight-on-bit, or a drill bit rotary speed.

13. The system of claim 8, wherein the measured rock property variable comprises a rock texture, a volume of quartz, a rock strength, a porosity, or a water saturation.

14. The system of claim 8, wherein determining parameters of a functional relationship between independent and dependent variables comprises:

determining a logarithm of the dependent and independent variables; and performing multiple linear regression on the logarithm of the dependent and independent variables.

* * * * *